US006434991B1

(12) United States Patent
Jaschka

(10) Patent No.: US 6,434,991 B1
(45) Date of Patent: Aug. 20, 2002

(54) FLOW-FORMING METHOD AND APPARATUS

(75) Inventor: Rudolf Jaschka, Ahlen (DE)

(73) Assignee: Leico GmbH & Co. Werkzeugmaschinenbau, Ahlen (DE)

( * ) Notice: Subject to any disclaimer, the term of this patent is extended or adjusted under 35 U.S.C. 154(b) by 0 days.

(21) Appl. No.: 09/709,413

(22) Filed: Nov. 13, 2000

(30) Foreign Application Priority Data

Dec. 15, 1999 (DE) ..... 199 60 582

(51) Int. Cl.[7] ..... B21B 27/06
(52) U.S. Cl. ..... 72/71; 72/82; 72/84; 72/110
(58) Field of Search ..... 72/71, 82, 84, 72/85, 110; 29/892.2, 892.3, 894.362

(56) References Cited

U.S. PATENT DOCUMENTS

| | | | | |
|---|---|---|---|---|
| 2,379,584 A | | 7/1945 | Litton | |
| 3,335,597 A | | 8/1967 | Gobien | |
| 4,823,580 A | | 4/1989 | Kadotani | |
| 5,823,904 A | | 10/1998 | Hodjat et al. | |
| 5,829,291 A | | 11/1998 | Tanaka et al. | |
| 5,941,113 A | * | 8/1999 | Kanemitsu et al. | 72/82 |
| 6,012,318 A | * | 1/2000 | Kanemitsu et al. | 72/71 |
| 6,105,410 A | | 8/2000 | Säuberlich et al. | |

FOREIGN PATENT DOCUMENTS

| | | | | |
|---|---|---|---|---|
| JP | 62-270219 | * | 11/1987 | 72/84 |

OTHER PUBLICATIONS

US 6,101,717, 08/2000, Shohara et al. (withdrawn)*

* cited by examiner

*Primary Examiner*—Ed Tolan
(74) *Attorney, Agent, or Firm*—Oblon, Spivak, McClelland, Maier & Neustadt, P.C.

(57) ABSTRACT

A method for flow-forming a part having an inner collar and an outer collar surrounding the inner collar, including clamping a workpiece having a radial section to a spinning tool in a flow-forming machine, splitting a first material off the radial section while rotating the workpiece by radially infeeding at least one spinning roller having a separating edge to form and shape the inner collar against the spinning tool, axially engaging a sliding sleeve displaceably mounted on the spinning tool over the inner collar, splitting a second material off the radial section by radially infeeding the at least one spinning roller while rotating the workpiece, and pressing the second material against the sliding sleeve to form and shape the outer collar.

11 Claims, 5 Drawing Sheets

FLOW-FORMING METHOD AND APPARATUS

FIELD OF THE INVENTION

The invention relates to a method for flow-forming a part having an inner collar and an outer collar, which surrounds the inner collar, as well as an apparatus for flow-forming such a part.

BACKGROUND OF THE INVENTION

For numerous purposes in gear technology gear parts are required having a radially inner, cylindrical sleeve section and an outer, cylindrical sleeve section surrounding the latter. Such gear parts with a so-called double collar or hub can be manufactured in various ways according to the prior art. Thus, such parts can e.g. be manufactured by casting or forging methods. However, these methods are limited with regards to the shaping variety and are only economic for the manufacture of large batches.

In the case of smaller batches such gear parts are frequently welded together from intermediate members. However, a shape-precise welding is scarcely possible, so that with this production procedure a complicated reworking of the welded part is often necessary. It is finally known to manufacture such gear parts in non-cutting manner by flow-forming. In this case in a first setting in a flow-forming machine a first hub is shaped by splitting and/or upsetting processes on a first spinning chuck. A reshaping of the workpiece on a flow-forming machine with a second spinning chuck adapted to the outer collar is then necessary and in a further method step the second outer collar is shaped. Conventional flow-forming machines are used for this method.

SUMMARY OF THE INVENTION

The object of the invention is to provide a method and an apparatus with which parts having a double collar or sleeve structure can be manufactured particularly economically.

According to the invention this object is achieved firstly by a method having the features according to claim 1 and secondly by an apparatus having the features of claim 7. Preferred embodiments of the invention are given in the dependent claims.

The invention therefore relates to a method for the flow-forming of a part having an inner collar and an outer collar, which surrounds the inner collar, wherein

- a workpiece with a workpiece section running in a radial direction is clamped to a spinning tool in a flow-forming machine,
- the workpiece is rotated and at least one spinning roller is radially infed,
- through the spinning roller material is partly separated on the radial workpiece section,
- the separated material is radially formed against the spinning tool and the inner collar is shaped,
- a sliding sleeve displaceably mounted on the spinning tool is engaged axially over the inner collar and
- with a spinning roller further material of the radial workpiece section is formed and pressed against the sliding sleeve, the outer collar being shaped.

One aspect of the invention is based on the fact that the workpiece with the two collars can be manufactured in a single setting. Apart from the spinning tool, at least one sliding sleeve is provided on said spinning tool, which following the shaping of the inner collar is engaged over the latter. In this position the sliding sleeve constitutes a second spinning tool, against which can be formed the second collar or the second, cylindrical circumferential section. This permits an efficient and therefore cost-effective manufacture of such gear parts.

In the sense of the invention the separation of the material for forming the collar can take place by flow-turning (the reduction of thickness leads to an elongation) or splitting/cutting, preference being given to the latter due to the low force expenditure and the reduced work-hardening. The spinning roller can be infed up to the spinning tool, so that the collar is finally shaped in clearly defined form and in complete manner between the spinning roller and the spinning tool.

A particularly dense, highly hardened material structure can be obtained in the collar. Alternatively a gap can be left between the spinning roller and the spinning tool, so that lower infeeding forces are required. However, then in the case of reduced hardening a material burr forms, which must be subsequently worked off.

According to the invention a particularly large multiplicity of shapes can be obtained in that during the forming of the outer collar a web of the radial material section is left behind and is subsequently reshaped.

According to a preferred procedure according to the invention the web is initially thickened and then provided with a profile. As a function of the desired final shape the thickening as an intermediate shape can in cross-section be oval, a symmetrical or asymmetrical drop, a cone or a rectangle. Such a thickening can then be further reshaped in advantageous manner and in particular provided with external teeth or a poly-V profile. The remaining circular blank web can be formed both to the side of the two collars formed for forming a third collar or on the opposite side. Besides external teeth it is also possible to shape on the reshaped web a corresponding inner profile, e.g. friction disk clutch teeth.

According to a preferred variant of the invention the inner collar is provided with an inner profile. For this purpose the spinning tool is provided with a corresponding outer profile, against which is spun the material split off or removed from the starting workpiece and is formed to a collar. Correspondingly an inner profile can be provided on the outer collar, in that the sliding sleeve is provided on its outside with a corresponding profiling. It is also possible by means of a correspondingly constructed sliding sleeve to stamp or cut in contouring on the outside of the inner collar.

According to a further development of the invention it is particularly advantageous to provide the outer collar with an outer profile, which can in particular be a tooth system or a poly-V contour.

According to the invention an extremely economic method is obtained in that the inner collar and/or the outer collar undergoes shaping in a radial infeed by means of a spinning roller, which has an outer contour corresponding to a desired collar shape. Through a simple replacement of such a spinning roller, it is possible to modify in simple manner the contour of the collar to be shaped. This is an important economic advantage particularly when manufacturing small and medium-sized batches.

On the basis of a flow-forming apparatus with a spinning tool, on which a workpiece is clamped, a drive for the rotary driving of the workpiece clamped to the spinning tool and at least one spinning roller with a separating edge for splitting off material and forming collars, according to the invention this object is also achieved in that a sliding sleeve is provided, which at the spinning tool is mounted in axially displaceable manner between a first position, in which the sliding sleeve is spaced from the workpiece for forming the inner collar, and a second position in which the sliding sleeve is located at the workpiece and embraces the shaped inner collar, and that an outer circumferential area of the collar is constructed in accordance with the inner contour of the shaped outer collar.

This flow-forming machine is suitable for performing the method according to the invention, leading to the advantages associated therewith. The starting workpiece can be in the form of sheet metal circular blanks, preshaped sheet metal parts or forged or cast workpieces made from the most varied materials.

According to a preferred embodiment of the invention there are two axially facing spinning tools between which the workpiece can be clamped. Thus, forming processes can be carried out on either side of the workpiece, so as to permit a particularly large variety of shapes.

According to the invention this is further developed in that on the two spinning tools is in each case provided a sliding sleeve. Thus, a double collar or sleeve structure can be constructed on both sides of the workpiece.

Another preferred embodiment of the invention comprises placing several sliding sleeves in telescopic manner on one spinning tool. Thus, two, three or more sliding sleeves can be arranged coaxially within one another, so that three, four or correspondingly more cylindrical collar areas can be constructed on one side of the workpiece.

The above-described invention can not only be used for the manufacture of gear parts, but also all other flow-formed parts, in which a double or multiple collar or sleeve structure is desired on one side of a workpiece. The clamping of the workpiece on the spinning tool can, as a function of the workpiece shape and the forming forces, take place by an axially acting overarm, a radially acting jaw chuck, a magnetic or vacuum clamping device, etc., or a combination of such clamping means.

BRIEF DESCRIPTION OF THE DRAWINGS

The invention is described in greater detail hereinafter relative to preferred embodiments and the attached drawings, wherein show.

DETAILED DESCRIPTION OF EMBODIMENTS

Figure 1:
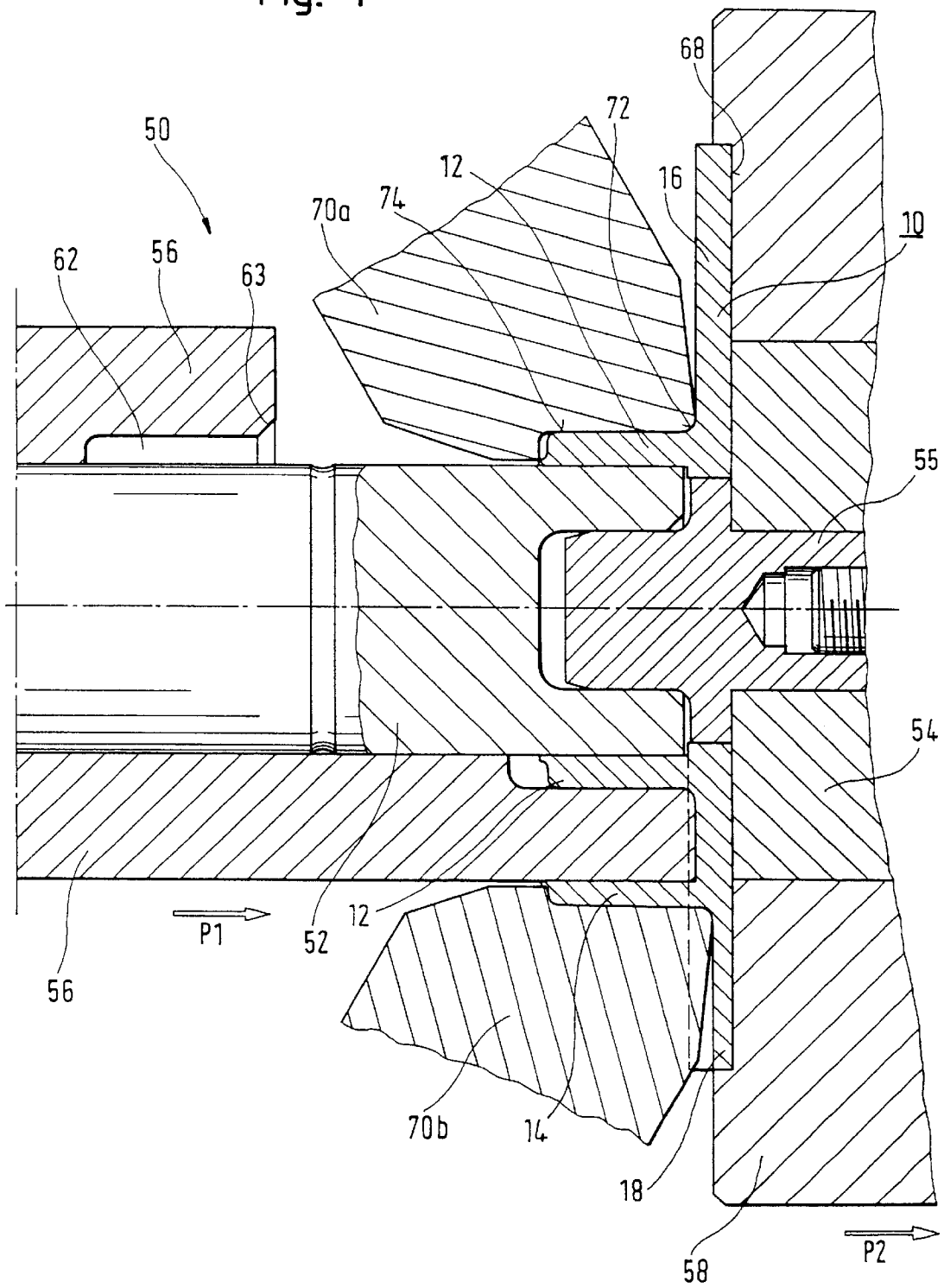
FIG. 1 A part cross-sectional view through a device according to the invention, the upper half showing the shaping of an inner collar and the lower half the shaping of an outer collar.

According to FIG. 1 a flow-forming machine 50 according to the invention has a first spinning tool 52 and a second spinning tool 54, between which is clamped a circular blank-like workpiece 10. The workpiece 10 has a central opening which, in the clamped position, is penetrated by a centring pin 55 of the second spinning tool 54 for centring purposes. A supporting sleeve 58 is displaceably mounted on the second spinning tool 54. Together with the second spinning tool 54 a recess 68 is formed, in which it is possible to insert in accurately fitting manner the workpiece 10.

For performing the method according to the invention spinning rollers 70*a* and 70*b* are radially infed, which leads to a reduction in the thickness of the workpiece 10, material is partly split off and shaped radially against the first, lefthand spinning tool 52 for forming an inner collar 12. For this purpose the spinning rollers 70*a*, 70*b* have a separating edge 72, to which is connected an upsetting area 74 corresponding to the desired contour of. the collar to be shaped. The state on ending this method stage of shaping the inner collar 12 on a radially directed workpiece section 16 is shown in the upper half of FIG. 1. During the shaping of the inner collar 12 a sliding sleeve 56 provided on the first spinning tool 52 is in a first position which, for forming a free space for the spinning rollers 70*a*, 70*b*, is spaced from the workpiece 10.

For shaping an outer collar 14 the sliding sleeve 56 is axially infed to the workpiece 10 in the direction of arrow P1. On its inside the sliding sleeve 56 has an annular groove 62 with an insertion bevel 63 and which are constructed for sliding in the shaped inner collar 12.

The annular groove 62 can have a surface contour, which effects a sizing or shaping of the outside of the shaped inner collar 12 on sliding in.

The sliding sleeve 56 is shown in a second position in the lower half of FIG. 1, where it engages against the workpiece 10 and embraces the inner collar 12. In this position spinning rollers 70*a*, 70*b* are again infed to the radial workpiece section 16 and corresponding to the shaping of the inner collar 12 an outer collar 14 is constructed. In this embodiment, even following the second splitting process, a radially outwardly projecting web 18 is left behind and is further reshaped following a movement and removal of the supporting sleeve 58 in the direction of the arrow P2.

Figure 2:
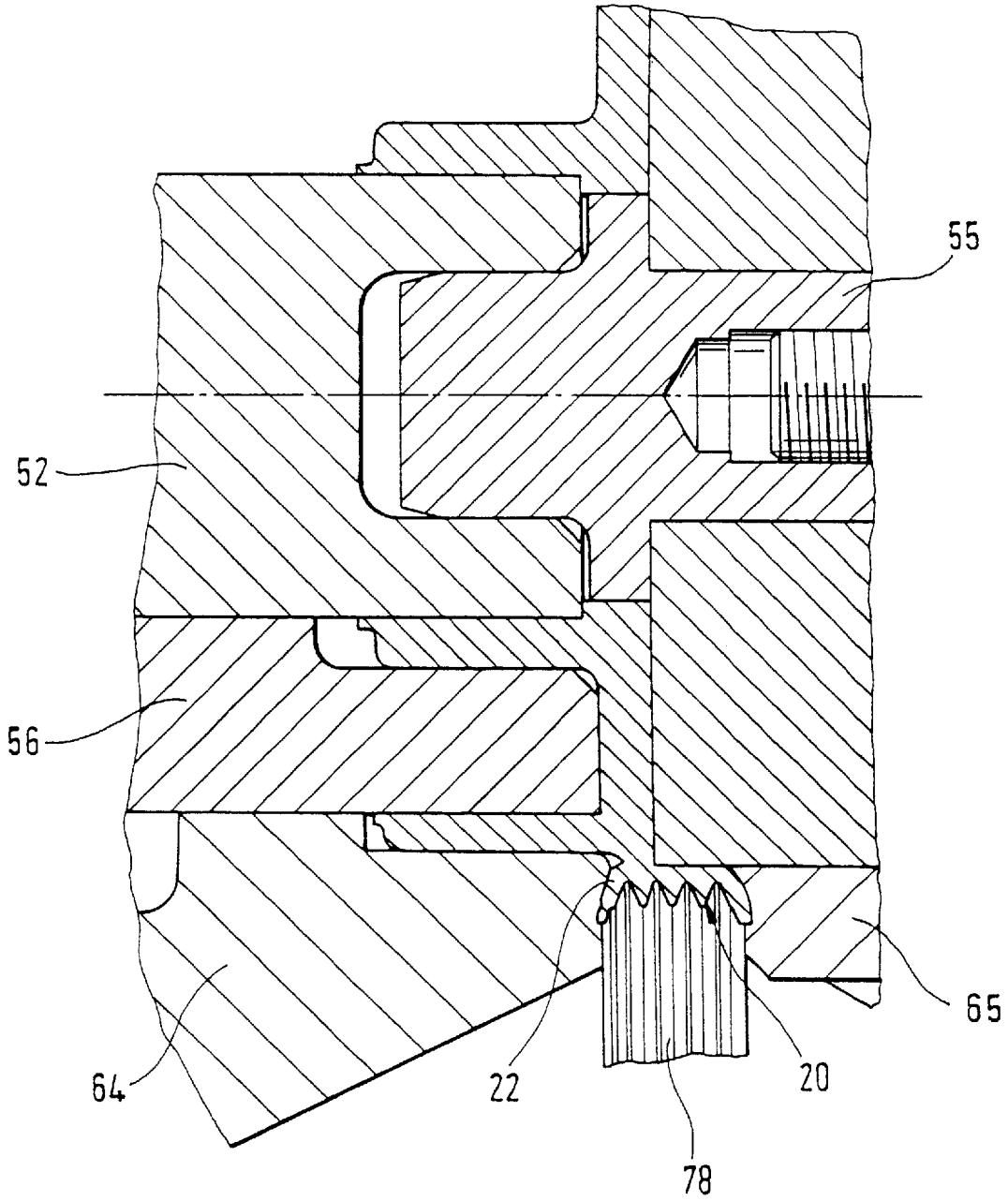
FIG. 2 A part cross-sectional view through the device according to the invention of FIG. 1 during the reshaping of an outer web area.

FIG. 2 shows the reshaping of the web 18 to a poly-V section 22 with a profile 20. For this purpose on sides of the first spinning tool 52 is infed a third sliding sleeve 64 and on sides of the second spinning tool a fourth sliding sleeve 65 axially to the workpiece 10 and a free space is formed corresponding to the section to be shaped. In a terminating method step, which optionally precedes an upsetting or thickening method step for preshaping the web 18, a poly-V roller 78 is radially infed and the workpiece section 22 is finally shaped with the profile 20.

Figures 3A, 3B, 3C, 3D, 3E, 3F, 3G, 3H:
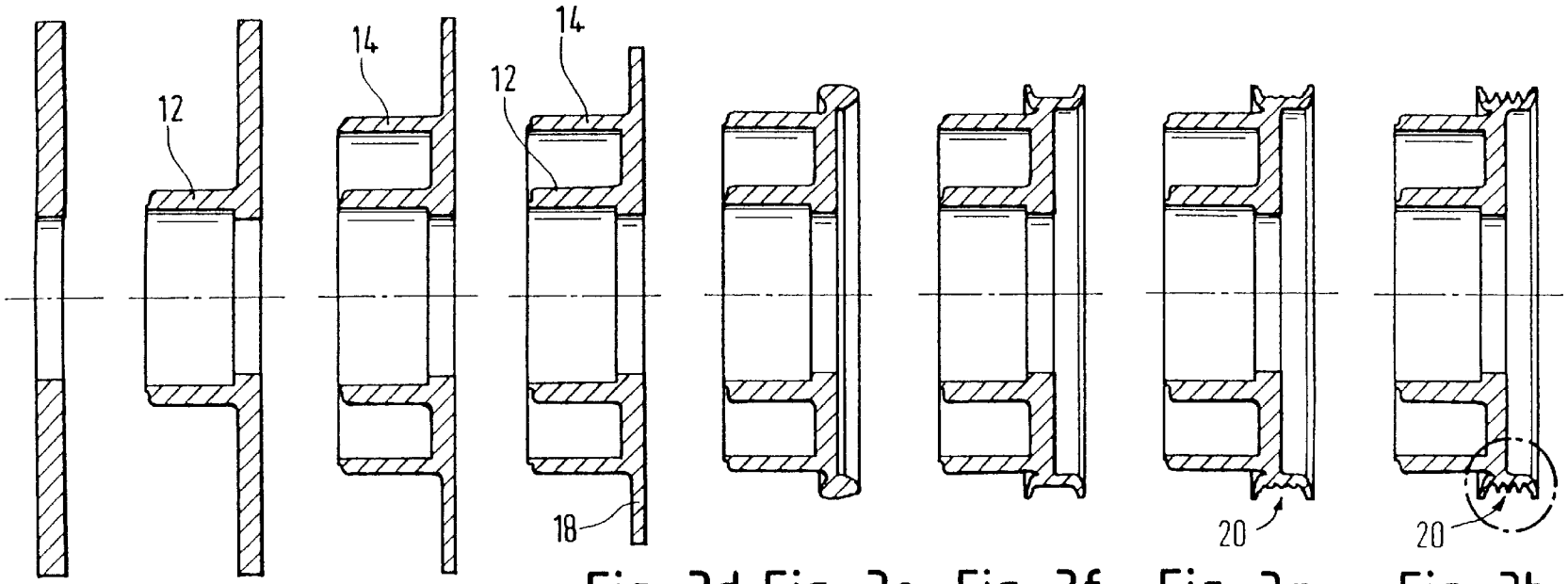
FIGS. 3*a*–3*i* Different cross-sectional views through a workpiece worked according to the invention in different method stages.
Figure 3I:
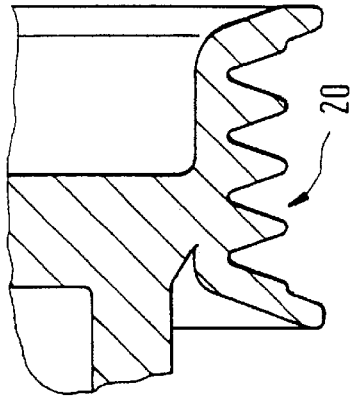

FIGS. 3*a* to 3*e* diagrammatically show the individual method stages for shaping the workpiece 10 according to FIGS. 1 and 2. Following the formation of the inner collar 12 and outer collar 14 according to FIGS. 3*a* to 3*d*, prior to the shaping of the poly-V profile the radially outer web 18 is initially thickened according to FIG. 3*e* and preshaped in two further method steps according to FIGS. 3*f* and 3*g*. FIG. 3*e* shows a larger-scale partial representation of profile 20.

Figure 4A:
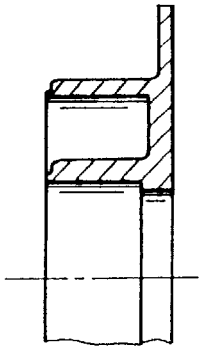
FIGS. 4*a*–4*f* Different cross-sectional views through a further workpiece worked according to the invention in different method stages.
Figure 4B:
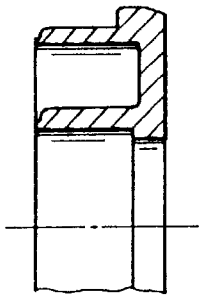
Figure 4C:
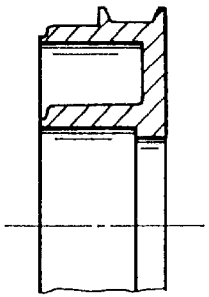
Figure 4D:
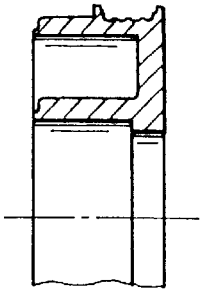
Figure 4E:
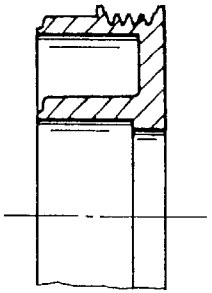

FIGS. 4*a* to 4*e* show a further variant of the method according to the invention. Following the construction of an inner collar and an outer collar in accordance with the above-described method, a radially outwardly projecting web corresponding to FIGS. 4*a* and 4*b* is spun radially inwards against the shaped outer collar. Then, in accordance with FIGS. 4*c* and 4*d*, a poly-V profile is preshaped and then according to FIG. 4*e* the poly-V profile is finally shaped directly on the thus thickened outer collar.

Figure 4F:
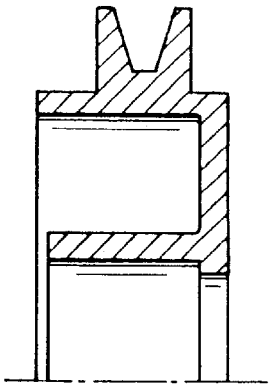

FIG. 4*f* shows a further method modification, in which a circumferential section is constructed with a single V-groove for a so-called V-belt.

Another variant of the method according to the invention is diagrammatically shown in FIGS. 5*a* to 5*d*. Starting with a circular blank, firstly an inner collar and an outer collar are shaped in accordance with the above-described method, as can be gathered from FIGS. 5*a* to 5*c*.

Figure 5D:
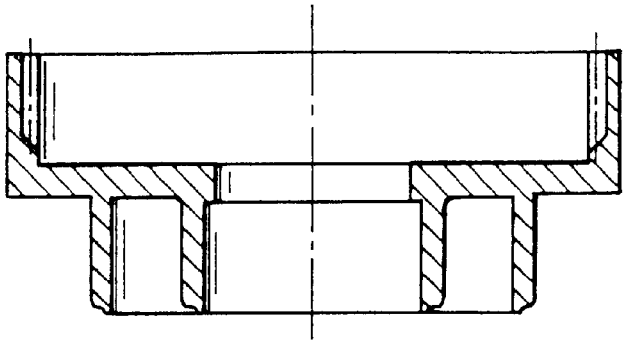
FIGS. 5*a*–5*d* Further cross-sectional views through a workpiece worked according to the invention in different method stages.
Figure 5C:
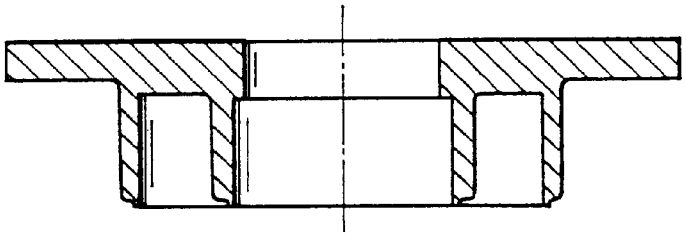
Figure 5B:
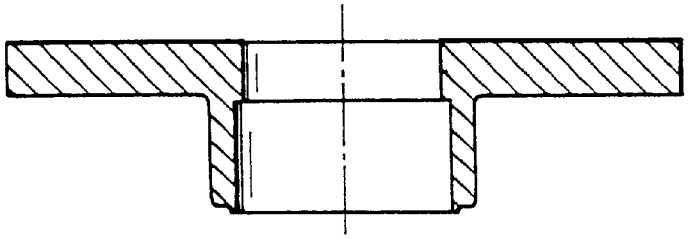
Figure 5A:
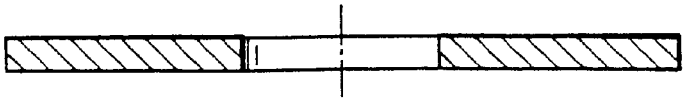

A remaining, radially outwardly projecting web in this embodiment according to FIG. 5*d* is reshaped to the opposite side on a not shown spinning tool provided on its outside with an outer profile.

On the thus reshaped cylindrical area is shaped inner teeth or so-called friction disk clutch teeth.

I claim:

1. A method for flow-forming a part having an inner collar and an outer collar surrounding the inner collar, comprising the steps of:

clamping a workpiece having a radial section to a spinning tool in a flow-forming machine;

splitting a first material off the radial section while rotating the workpiece by radially infeeding at least one spinning roller having a separating edge to form and shape the inner collar against the spinning tool;

axially engaging a sliding sleeve displaceably mounted on the spinning tool over the inner collar;

splitting a second material off the radial section by radially infeeding the at least one spinning roller while rotating the workpiece; and pressing the second material against the sliding sleeve to form and shape the outer collar.

2. A method according to claim 1, further comprising forming a web in the radial section left behind.

3. A method according to claim 2, further comprising:

thickening the web; and providing a profile onto the web.

4. A method according to claim 1, further comprising providing an inner profile onto the inner collar.

5. A method according to claim 1, further comprising providing an outer profile onto the outer collar.

6. A method according to claim 1, wherein at least one of the steps of splitting first and second materials comprises radially infeeding a spinning roller having an outer contour corresponding to a desired collar shape in forming at least one of the inner and outer collars into the desired collar shape.

7. An apparatus for flow-forming a part with an inner collar and an outer collar surrounding the inner collar, said apparatus comprising:

at least one spinning tool configured to clamp a workpiece thereon;

a driving device configured to rotate the workpiece clamped on the spinning tool;

at least one spinning roller having a separating edge positioned to separate a material off the workpiece, the at least one spinning roller being configured to form the inner and outer collars; and at least one sliding sleeve provided on the at least one spinning tool and configured to move between a first position in which the at least one sliding sleeve is kept from the workpiece for forming the inner collar and a second position in which the at least one sliding sleeve surrounds the inner collar.

8. An apparatus according to claim 7, wherein the at least one spinning tool comprises two axially facing spinning tools configured to clamp the workpiece therebetween.

9. An apparatus according to claim 8, wherein the two axially facing spinning tools each include a sliding sleeve configured to move between a first position in which the sliding sleeve is kept from the workpiece for forming the inner collar and a second position in which the sliding sleeve surrounds the inner collar.

10. An apparatus according to claim 7, wherein the at least one sliding sleeve comprises a plurality of sliding sleeves telescopically provided on the at least one spinning tool.

11. An apparatus according to claim 7, wherein the at least one sliding sleeve has an outer circumferential area configured to shape an inner contour of the outer collar.

* * * * *